US005401151A

United States Patent [19]

Allen

[11] Patent Number: 5,401,151

[45] Date of Patent: Mar. 28, 1995

[54] VACUUM PUMPS

[75] Inventor: Richard G. Allen, South Croydon, England

[73] Assignee: The BOC Group plc, Windlesham, England

[21] Appl. No.: 140,810

[22] Filed: Oct. 21, 1993

[30] Foreign Application Priority Data

Oct. 22, 1992 [GB] United Kingdom ..... 9222227

[51] Int. Cl.[6] ..... F01C 1/08

[52] U.S. Cl. ..... 418/191; 418/9

[58] Field of Search ..... 418/9, 191, 200

[56] References Cited

U.S. PATENT DOCUMENTS 4,076,469 2/1978 Weatherston ..... 418/9

4,437,818 3/1984 Weatherston ..... 418/9

5,099,050 9/1991 Berges et al. ..... 418/9

*Primary Examiner*—Richard A. Bertsch

*Assistant Examiner*—Charles G. Freay

*Attorney, Agent, or Firm*—David M. Rosenblum; Larry R. Cassett

[57] ABSTRACT

A mechanical vacuum pump is provided with a pair of cooperating rotors mounted on rotatable shafts within a pumping chamber. Each of the pair of cooperating rotors has a claw profile that terminates in a leading edge shaped to present an angle of no greater than 90 degrees relative to the wall of the pumping chamber. The leading edge shaped in such manner helps to prevent contaminant buildup on the wall of the pumping chamber.

1 Claim, 3 Drawing Sheets

VACUUM PUMPS

BACKGROUND OF THE INVENTION

This invention relates to mechanical pumps and room particularly to mechanical vacuum pumps incorporating at least one pair of intermeshing rotors, especially rotors of the type known as "claw" rotors, i.e. ones having a "Northey" profile.

Mechanical vacuum pumps of the above kind generally have one rotor of each pair mounted on a first con,non shaft and the other rotor of each pair mounted on a second common shaft. The shafts are positioned in the pump body with the rotors mounted thereon being held in the correct phase relationship by means of a gear at one end of each shaft and by bearings generally positioned at both ends of each shaft; the shafts are therefore arranged for synchronized rotation in opposite directions to cause intermeshing, normally without contact, between the rotors of each pair.

In a single stage pump, the one pair of rotors is constrained to rotate in the above fashion in a single chamber. In general, however, pumps of this type are multistage with each pair of rotors operating in respective chambers that are linked by means of porting within the walls of adjacent chambers. In accordance with the disclosures of our British Specification No 2 111 126, the pairs of rotors in adjacent chambers may usefully be mounted on their respective shafts in reverse orientation to the pairs in the next chamber, thereby making the porting, and in particular its overall length and positioning in the pump, better in comparison with pumps whose rotor pairs are mounted on their shaft in the same orientation.

Normally, pumps of this type are operated with oil-free and lubricant-free pumping chambers and any oil or lubricant associated with the motor which drives one of the shafts, with the timing gears (or whatever) present for synchronized rotation of the shafts or with the bearings holding the shafts in position within the pump body, can be kept clear of the pumping chambers. Problems can sometimes occur in dry pumps of this type when gases or vapors which are heavily laden with powders, dust particles or other particulate matter or when such gases or vapors have a tendency to sublime or otherwise form a coating on the surface of the walls of the pump chambers. The processing of semi-conductor materials in particular is known to produce significant quantities of such contaminants which must be evacuated from the processing chamber.

Although the absence of lubricants within the pump chamber makes dry pumps suitable for pumping particle-laden gases and vapors—and such lubricants tend to act as a "scrubber" for the particles and can produce an abrasive slurry effective to induce rapid wear on the internal surfaces of the pump—it has been found that there can nonetheless be a progressive build up of contaminants on the chamber walls which ultimately can lead to seizure of the pump if the build up prevents the rotors having sufficient working clearance with the chamber walls. The present invention is concerned with minimizing the degree of contaminant build up on the chamber walls of the pump.

SUMMARY OF THE INVENTION

In accordance with the invention, there is provided a mechanical vacuum pump that includes a pumping chamber having a wall. A pair of rotatable shafts pass through the pumping chamber and a pair of cooperating rotors operated in the pumping chamber. The pair of cooperating rotors are mounted on the rotatable shafts for rotation in opposite directions. Each of the pair of cooperating rotors has a claw profile terminating in a leading edge. The leading edge is shaped so as to present an angle of no greater than 90 degrees relative to the wall of the pumping chamber to help prevent or minimize contaminant build up on the pumping chamber wall.

It is important for each claw rotor to retain its overall standard profile of known shape except in respect of the leading edge in the vicinity of the pumping chamber wall. In that area, the rotor not already having a perpendicular or acute angle leading edge will be cut away to provide the desired leading edge angle in accordance with the invention.

For a better understanding of the invention, reference will now be made, by way of exemplification only, to a further drawing, FIG. 3 which shows a schematic sectional view through a pumping chamber for a pump of the invention.

DETAILED DESCRIPTION

Figure 1:
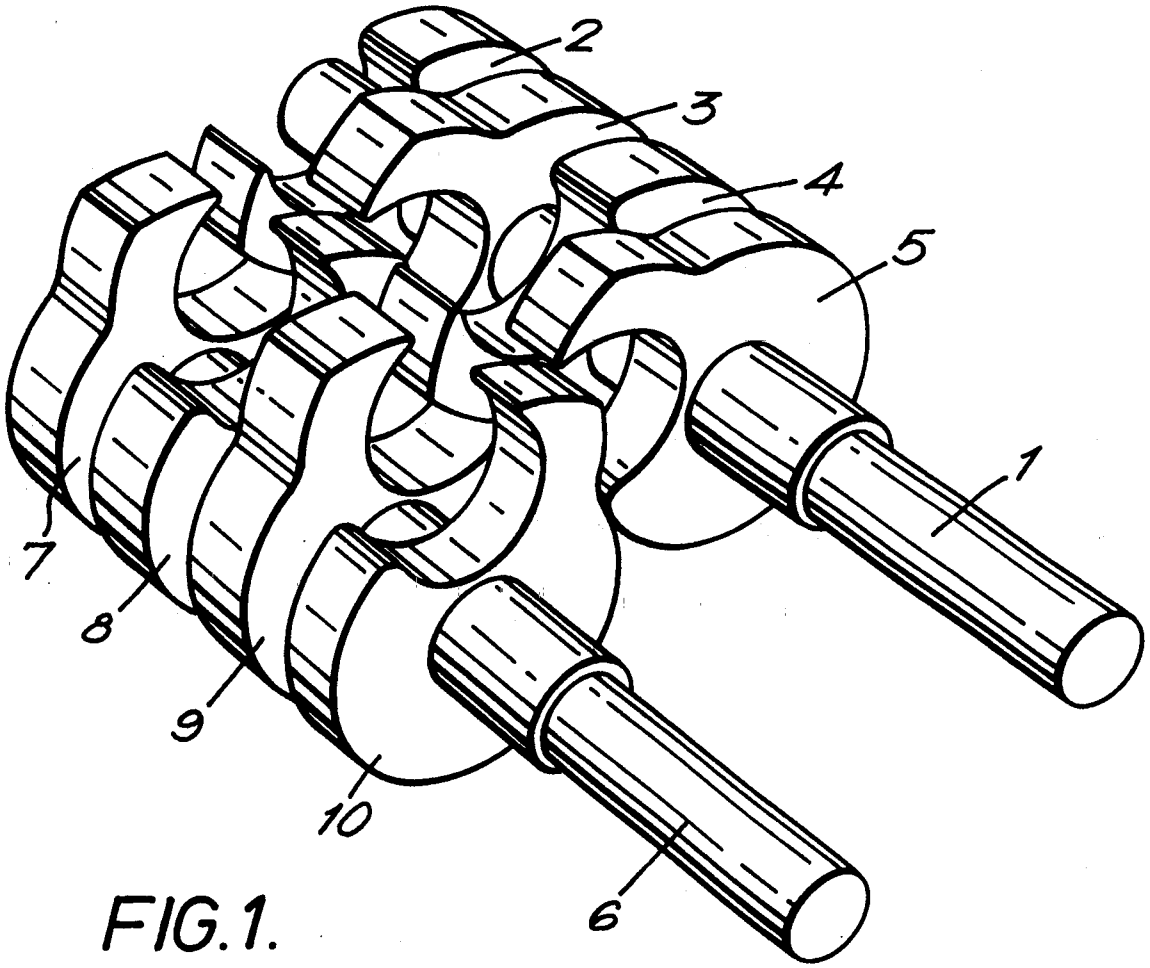
FIG. 1 is a perspective view of a typical construction of the shafts and attached Claw rotors for a four-stage vacuum pump.

With reference to FIG. 1 of the drawings, a first shaft 1 carries four Claw rotors 2,3,4,5 and a second shaft 6 cart its four further Claw rotors 7,8,9,10. The corresponding rotor pairs 2,7; 3,8; 4,9; 5,10 are arranged within a pump body (not shown) to co-operate in individual chambers in a predetermined and fixed place relationship with each rotor pair being in reverse orientation to the adjacent pair in accordance with the disclosures of British Patent Specification No. 2 111 126 discussed above. The operation of the rotor pair 5,10 in particular is shown more clearly in the sectional view of FIG. 2.

Figure 2:
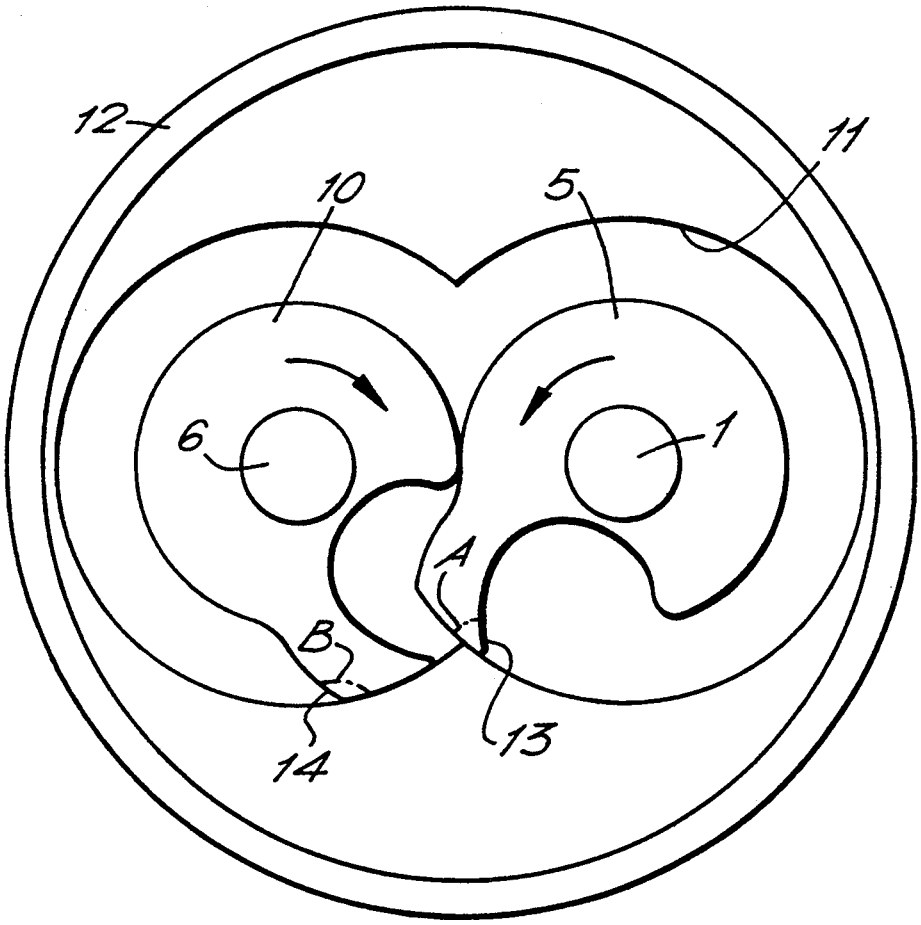
FIG. 2 is a schematic sectional view of a conventional rotor pair of the vacuum pump of FIG. 1.

With reference to FIG. 2, the rotors shown therein have a typical Claw rotor profile and the rotors are designed to rotate in opposite directions as indicated by the arrows to sweep volumes of gas and urge them into the next pump chamber through ports therebetween in a manner known per se within the confines of the chamber wall 11 within the pump body 12.

During such rotation in use of the pump, there is a very fine radial clearance between the relevant part of the chamber wall 11 and the claws of the rotors 5 and 10. Therefore, any build up of contaminants on the surfaces of the chamber wall could lead to loss of operating clearance and eventually seizure of the pump as a whole.

It is generally accepted that the overall shape of the Claw rotors is critical in achieving good pumping efficiencies. It is apparent from FIG. 2 in particular that the leading edge 13 of the claw of the rotor 2 has an acute angle 'A' relative to the chamber wall such that during rotation in the direction shown by the arrow the edge can act like a "snow plough" to scrape any contaminants from the chamber wall.

It is equally apparent that the leading edge 14 of the claw of the rotor 10 has an obtuse angle 'B' relative to the chamber wall such that during rotation in the direction shown by the arrow there is no scraping effect. In fact, it has been found that the action of the leading edge 14 of the rotor 10 (as shown in FIG. 2) tends to urge contaminants between the rotor and the chamber wall, thereby exacerbating the clearance problem.

Figure 3:
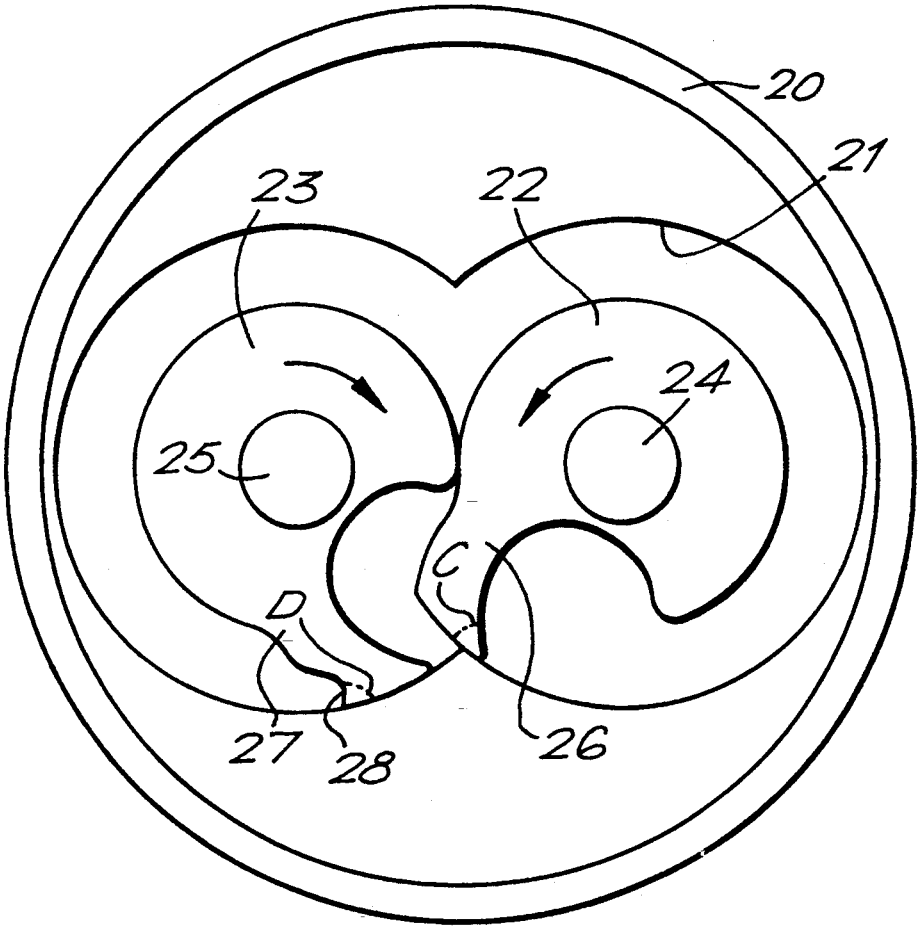
FIG. 3 is a schematic sectional view of a rotor pair of the present invention mounted within a pump chamber of a pump body.

With reference to FIG. 3, there is shown a pump body 20 with a "figure-of-eight" pumping chamber 21 defined therein. Two claw profile rotors 22,23 in accordance with the present invention are mounted on respective shafts 24,25 which are adapted for rotation about their longitudinal axes in opposite directions as shown by the arrows; the rotors 22,23 have respective claws 26,27.

The rotors are mounted on the shafts in a predetermined fixed phase relationship such that they are adapted to sweep the pump chamber with a fine radial clearance between the tips of the claws 26,27 of the rotors 22,23 respectively.

The leading edge of the claw 26 presents, as is usual in pumps of this type, an acute angle 'C' relative to the relevant part of the wall of the chamber.

In accordance with the invention, the lending edge of the claw 27 of the rotor 23 contains a cut away portion 28 shaped to produce a reversal in curvature throughout the width of the edge such that this rotor also presents an acute angle 'D' relative to the relevant part of the wall of the chamber. As has been previously mentioned, although the overall profile of the rotors is to be maintained, rotors in accordance with the present invention could be shaped such that their leading edges were anywhere up to and including 90 degrees.

In use of the pump, therefore, both leading edges can be effective at scraping off any contaminants from the walls of the pumping chamber, thereby allowing the contaminants to be swept out of the chamber during normal use or, alternatively flushed from the chamber with purge gas at the end of an evacuation cycle using the pump.

I claim:

1. A mechanical vacuum pump including: a pumping chamber having a wall; a pair of rotatable shafts passing into said pumping chamber; and a pair of cooperating rotors operating in the pumping chamber, said pair of cooperating rotors mounted on said rotatable shafts for rotation in opposite directions, each of said pair of cooperating rotors having a claw profile terminating in a leading edge shaped so as to present an angle no greater than 90 degrees relative to the wall of the pumping chamber and the leading edge of one of said pair of cooperating rotors having a cut away portion shaped to produce a reversal and curvature thereof such that said angle of said leading edge of said one of said pair of cooperative rotors comprises an acute angle.

* * * * *